United States Patent [19]

Jerles

[11] 4,094,166

[45] June 13, 1978

[54] AIR CONDITIONING CONTROL SYSTEM

[75] Inventor: James B. Jerles, Tierra Verde, Fla.

[73] Assignee: Electro-Thermal Corporation, Pensacola, Fla.

[21] Appl. No.: 780,665

[22] Filed: Mar. 23, 1977

[51] Int. Cl.[2] ..... F25B 41/00

[52] U.S. Cl. ..... 62/158; 62/180; 236/46 R

[58] Field of Search ..... 62/231, 158, 180, 157; 236/DIG. 9, 46 R

[56] References Cited

U.S. PATENT DOCUMENTS

| | | | |
|---|---|---|---|
| 2,953,908 | 9/1960 | Petrone et al. | 62/231 X |
| 3,545,218 | 12/1970 | Greenberg | 62/157 |
| 4,041,723 | 8/1977 | Weibel, Jr. et al. | 62/231 X |

*Primary Examiner*—William E. Wayner

*Attorney, Agent, or Firm*—Gust, Irish, Jeffers & Rickert

[57] ABSTRACT

An air conditioning system having a refrigerant system including a compressor, a condenser coil and fan, and an evaporator coil and fan and including a control system which comprises an electrically operated timer switch for alternately connecting the compressor for a preselected first period of time and disconnecting said compressor for a preselected second period of time, a thermostat for starting the timer when the sensed ambient temperature falls outside a preselected temperature range and for stopping and overriding the timer to disconnect the compressor from the terminals when the ambient temperature falls within the preselected temperature range. The evaporator fan continues to run after the compressor has been turned off thereby continuing to provide additional air cooling without the expenditure of energy to run the compressor.

13 Claims, 2 Drawing Figures

AIR CONDITIONING CONTROL SYSTEM

BACKGROUND OF THE INVENTION

The present invention relates to air conditioning systems of either the heating or cooling type wherein air from a room or building is drawn into the unit and passed over heating or cooling coils prior to being recirculated back into the room or building. The present disclosure is primarily concerned with air conditioning systems of the cooling type, but the invention is equally applicable to heating systems, or heating/cooling apparatus such as heat pumps.

In many central air conditioning systems presently in use, a thermostat deployed at some point in the building senses the temperature of the ambient air and if it is higher than the comfort setting which has been selected, activates the air conditioning unit. Such a unit normally comprises a compressor, condenser, and evaporator connecting with each other in a closed refrigerant system. The gaseous refrigerant is delivered from the compressor to the condenser coil where it gives up heat and then is passed through an expansion valve to the evaporator coil where it absorbs heat from the circulating air which is passed thereover by the evaporator fan. When the thermostat senses that the ambient air has been cooled to the desired level, the compressor, evaporator fan and condenser fan are turned off until the ambient temperature has again reached the level where further cooling is necessary.

Although the compressor has been deactivated, the evaporator coils remain cool because of the fact that the refrigerant is vaporized at a low temperature. Normally, no utilization is made of the cooling capacity of the evaporator coil, however, because the evaporator fan is turned off with the compressor. This results in inefficient utilization of the energy required to compress the refrigerant.

In almost all window air-conditioners, the evaporator fan runs constantly and the compressor is cycled on and off depending on the temperature of the ambient air sensed by the thermostat. Although circulating air continues to pass around the evaporator coil even after the compressor has been turned off so that as much heat is possible is imparted to the coil, the air will continue to circulate even after the temperature of the evaporator coil has attained the temperature of the air. This often results in an unpleasant odor being imparted to the circulating air produced by certain microorganisms and other contaminants such as nicotine which collect on the evaporator coil and in the drip pan of the air conditioner. U.S. Pat. No. 3,762,178 discusses this problem and attempts to solve it by delaying the start of the evaporator fan until the evaporator coil has reached a temperature where dew forms thereon. Although such a technique will tend to eliminate the unpleasant odor, the evaporator fan is still cycled off with the compressor so that the full cooling capacity of the evaporator coil is not utilized.

In certain situations, the compressor runs constantly and the customary thermostat controlled cycling does not occur. Although continuous operation of the system may be necessary for proper cooling and ventilation, prolonged running of the compressor will be deleterious from the standpoint of its operating life and may necessitate that a larger capacity motor be used than that which would normally be required for the compressor in order to accommodate the increased load.

Although prior art systems which employ a timer cycled compressor are known, the same results as those achieved by the present invention are not realized. In U.S. Pat. No. 3,545,218, a timer is utilized to alternately switch the compressor on and off but the duration of the "on" period relative to the "off" period varies depending on the ambient temperature sensed by the thermostat. Such an arrangement does not permit the duration of the relative intervals to be absolutely controlled and results in the compressor being restarted before maximum cooling is achieved by the deactivated system. In U.S. Pat. No. 2,969,652, a time clock is utilized to energize the compressor at a selected time of day, for example in the morning, and de-energize the compressor at a later time, for example at night. The evaporator fan is also placed under the control of the clock, however, and ceases to run when the compressor is de-energized.

SUMMARY OF THE INVENTION

The present invention overcomes the disadvantages of the prior art by providing control means which automatically cycles the compressor on and off for predetermined time periods as the evaporator fan continues to run. Although the system is under the overall control of an ambient temperature thermostat, during the times when cooling is required, the compressor will be de-energized for a preselected fraction of the cooling period and the evaporator fan will continue to circulate air over the evaporator coil. As the liquid refrigerant is admitted to the coil through the expansion valve or capillary tube it is usually completely vaporized before it reaches the outlet connection. At this point in time, the refrigerant vapor is very cold and when the compressor is de-energized, the vapor will continue to absorb heat from the air passing over the coil.

The liquid refrigerant not only absorbs the amount of heat necessary to vaporize it but will absorb heat to the point of superheating the vapor. It will continue to extract heat from the air until the vapor absorbs all the heat of which it is capable and the temperature of the coil reaches that of the circulating air, for example, 75°. It has been found that after approximately 6 minutes, the evaporator coil and vapor will reach the temperature of the circulating air and no further cooling will occur. At this point, the compressor will be restarted, either after the predetermined interval of time or by the tripping of the temperature sensor, compressing the superheated vapor and further cooling will thereby occur.

In its broadest sense, the present invention contemplates an air conditioning system for maintaining ambient air within a desired temperature range comprising: a heat exchanger, selectively activated energy transfer means for maintaining the heat exchanger within a given first temperature range, motor operated fan means for forcing a stream of air through the heat exchanger, timer means for alternately activating the energy transfer means for a predetermined fixed period of time and deactivating the energy transfer means for a preselected second period of time, control means including an ambient temperature sensor for starting the timer means when the sensed ambient temperature falls outside a preselected second temperature range and stoppiing the timer means and overriding it to deactivate the energy transfer means when the sensed ambient temperature falls within said second range, the ratio of said first and second periods remaining constant regardless of the ambient temperature sensed by the control means, and the motor operated fan means continuiing to run during the period when the energy transfer means is deactivated.

It is an object of the present invention to provide an air conditioning system wherein the compressor is alternately cycled on and off for predetermined intervals of time whereby the temperature of the evaporator coil remains at or below a given temperature throughout the cooling cycle.

It is a further object of the present invention to provide an air conditioning system wherein the evaporator fan runs continuously over the cooling cycle yet the compressor is de-energized for a predetermined fraction of the cycle thereby permitting cooling even though no energy is being expended to operate the compressor.

Another object of the present invention is to provide an air conditioning system wherein the compressor cycles on and off for predetermined intervals of time over the cooling cycle and includes a thermostat downstream from and in close proximity to the evaporator coil which serves to automatically override the compressor timing mechanism to re-energize the compressor if the evaporator coil temperature rises above a preselected level prior to the timer controlled reenergization of the compressor.

A still further object of the present invention is to provide an air conditioning system wherein the life of the compressor is extended and the need for an overcapacity compressor eliminated by causing the compressor to be operated intermittently over the cooling cycle.

DESCRIPTION OF THE PREFERRED EMBODIMENT

Figure 1:
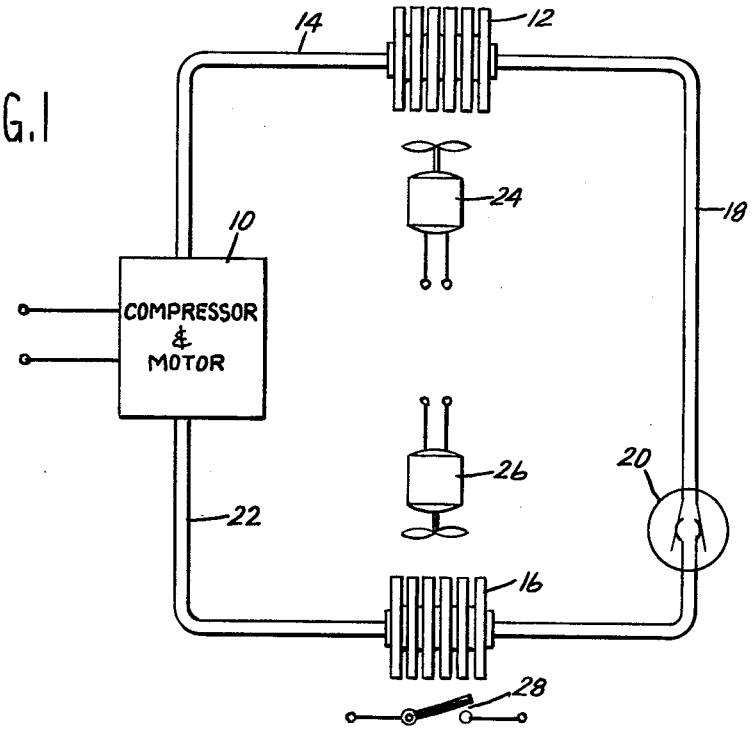
FIG. 1 is a schematic view of the refrigerant system forming a portion of the present invention.

Referring first to FIG. 1, the refrigerant system of the present invention is illustrated. It comprises a compressor 10 having its high pressure side leading to a condenser coil 12 through a refrigerant line 14, the condenser 12 leading to evaporator coil 16 through a refrigerant line 18 and an expansion valve or capillary tube 20, and the evaporator coil 16 connecting with the low pressure side of condenser 10 through refrigerant line 22. The compressor 10 and the condensor coil 12 may be considered as an energy transfer means and 16 may be considered to be a heat exchanger. Condenser coil 12 is provided with a fan or blower 24 for circulating air through it to a point external to the room or building which is to be cooled. In window air conditioners, the condenser coil 12 is customarily positioned within the rear of the unit housing so that it is located outside the room. Similarly, evaporator coil 16 is provided with a fan or blower 26 which circulates air from the room or building through coil 16 where it is cooled and then directs it back into the room or redistributes it throughout the building.

As is well known, in the cooling mode of an air conditioner or heat pump, gaseous refrigerant leading from line 22 to compressor 10 is compressed within condenser 12 where it condenses and releases its latent heat and superheat to the air circulated around it by blower 24. The compressed refrigerant is thereby cooled and then delivered through expansion valve 20 into evaporator 16 where, due to the lower pressure, it vaporizes and withdraws heat from the building or room air circulated by fan 26 thereby lowering its temperature. The vaporized refrigerant is then drawn into compressor 10 through low pressure line 22 for recondensing.

A thermostat 28 is positioned downstream from fan 26 and evaporator coil 16 and in close proximity to coil 16, for example, approximately 6 inches. The purpose of thermostat 28 is to sense the immediate cooling effect of evaporator 16 in order to override the compressor cycling timer under certain conditions, as will be described more fully hereafter.

Figure 2:
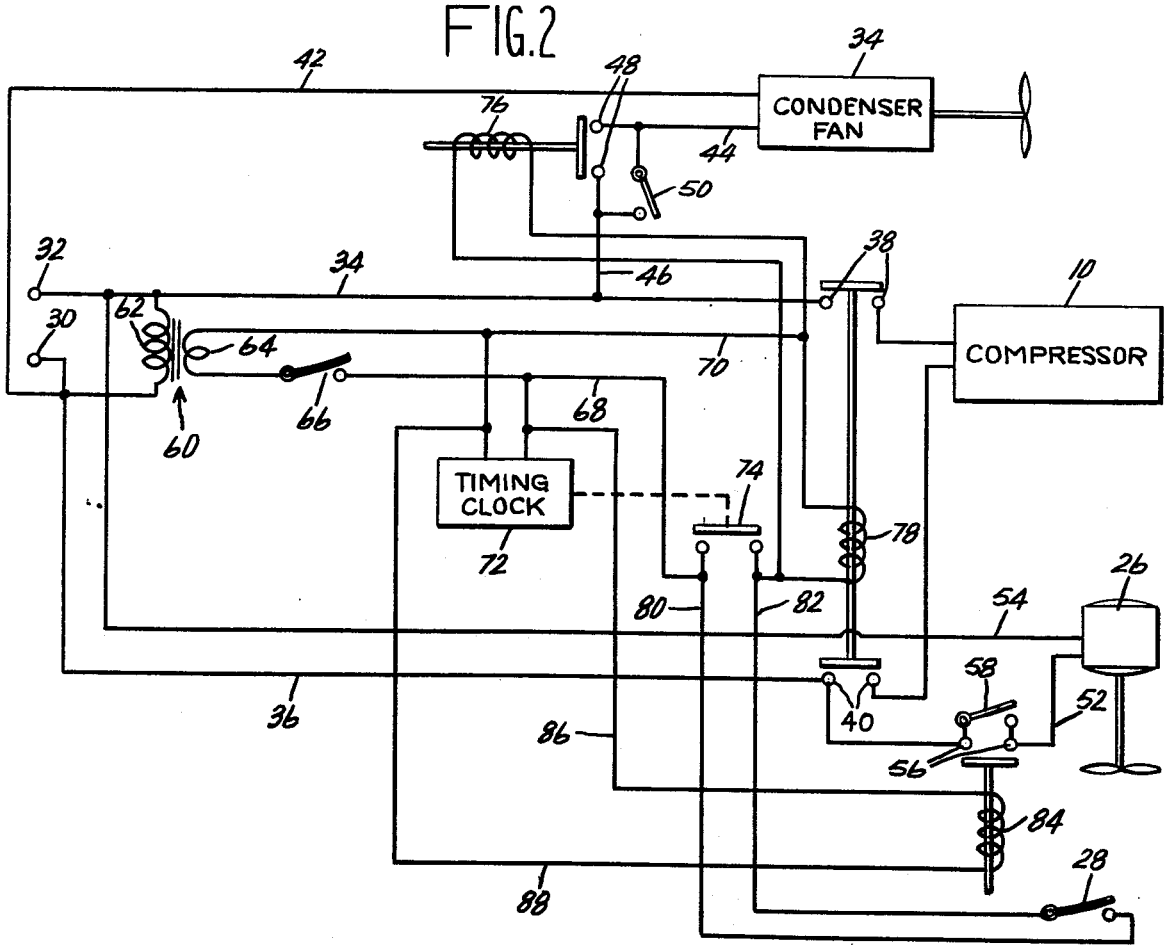
FIG. 2 is a schematic view of the control system of the present invention.

In FIG. 2, the electrical control system is shown in detail. 220 volts A.C. is provided at terminals 30 and 32 from any suitable external source. Compressor 10, which requires a 220 volt power source is connected to terminals 30 and 32 through lines 34 and 36 and relay contacts 38 and 40, respectively. Of course, a voltage source of 220 volts is merely exemplary and any suitable voltage may be utilized depending on the size and characteristics of the equipment. Condenser fan 34 is also connected to terminals 30 and 32 through lines 42, 44, 46, and 34. Relay contacts 48, which are bridged by switch 50, provide switching for fan 34. Fan 26 is connected to terminals 30 and 32 through lines 52, 36 and 54. Relay contacts 56 and switch 58 provide switching for fan 26.

In addition to the high voltage circuit just described, there is also provided a low voltage control circuit which comprises a stepdown transformer 60 having a primary coil 62 and a secondary coil 64 which serves to step the 220 volts down to a suitable control voltage such as 24 volts, for example. A thermostat 66, which is preferably placed at a central location within the room or building, is connected in series with low voltage line 68. In the cooling mode, when the ambient temperature exceeds a preselected comfort setting, for example 72°, thermostat 66 will close thereby placing the 24 volt control voltage across lines 68 and 70.

A percentage timer 72, such as Zenith Percentage Timer model CP-30M, is connected across lines 68 and 70 such that it will be activated whenever thermostat 66 closes. Timer 72 is a continuous cycling control which, when activated, closes its switch 74 for a preselected percentage of the total time cycle. The total time cycle can be chosen from a variety of ranges, for example, 12 hours, 1 hour, 30 minutes, etc. If a total time cycle of 30 minutes were selected and the percentage timer set at "20%", switch 74 would close for 24 minutes, open for 6 minutes, close for 24 minutes, and so on.

Relays 76 and 78 are connected in parallel with each other and in series with timer switch 74 across low voltage lines 68 and 70 which include series connected thermostat 66. Thermostat 28, which is in close proximity to evaporator 16, bridges timer switch 74 through lines 80 and 82. Relay 84, which has contacts 56 in series with fan 28, is connected directly across low voltage lines 68 and 70 through lines 86 and 88. The contacts 48 and 38, 40 of relays 76 and 78, respectively are normally open and are closed only when thermostat 66 and either timer switch 74 or thermostat 28 are closed. Evaporator fan 26, on the other hand, runs whenever room thermostat 66 closes.

OPERATION

Assume that the room or building thermostat 66 is set to open at 75° and that the ambient room temperature is 74°. This causes thermostat 66 to open thereby de-energizing compressor 10, condenser fan 34 and evaporator fan 26. Of course, if special circumstances require a greater degree of ventilation, evaporator fan 26 could be run continuously by closing switch 58.

Assume now that the ambient temperature reaches 76° thereby causing thermostat 66 to close. This energizes timer 72 which closes switch 74 (assuming the timer 72 is just commencing its cycle) thereby energizing relay 78 which closes contacts 38 and 40 connecting compressor 10 across input terminals 30 and 32. Relay 76 will also be energized so that contacts 48 close and the condenser fan 34 begins to run.

After compressor 10 has run for 24 minutes, timer 72 will open switch 74 thereby de-energizing relays 76 and 78 and disconnecting compressor 10 and condenser fan 34 from input terminals 30 and 32. Evaporator fan 26 will continue to run, however, by virtue relay 84 being connected directly across low voltage lines 68 and 70. Because of the superheating phenomenon discussed above, evaporator coil 16 will remain cold and as air is continued to be circulated around it by fan 26, additional cooling will continue even though the compressor 10 has been deactivated.

After the 6 minute "off" period has expired, timer 72 will again close switch 74 thereby energizing relays 78 and 76 to again connect compressor 10 and condenser fan 34. Of course, if the room or building temperature is lowered sufficiently to open thermostat 66, timer 72 will stop and relays 78 and 76 as well as relay 84 will be deactivated so that compressor 10 and fans 26 and 34 will be shut off.

If, during the six minute "off" period the temperature of the evaporator coil 16 rises to the point where sufficient cooling cannot occur, thermostat 28 will close thereby bridging switch 74 and energizing compressor 10 and condenser fan 34. A recommended temperature range for thermostat 28 has it open at 64° and below, and closed at 75° and above. Thermostat 66 may be set to close at an ambient temperature of 76°.

Under normal cooling conditions, with the compressor "off" for 6 minutes and "on" for 24 minutes, a 20% savings in electrical energy is realized. Because of the superheating of the refrigerant in the evaporator 16 during the "off" period, the temperature change in the air conditioned area during this period may be as low as 0.08°, which is a negligible change. It has been found that after approximately six minutes, the temperature of the superheated vapor reaches approximately 75°, at which point no further cooling can occur and the compressor is automatically re-energized.

Of course, the embodiment described above is merely exemplary and a number of modifications can be made without departing from the spirit and scope of the invention. For example, domestic window units and air conditioning units for motels and the like, where the capacity does not exceed 18,000 BTU, are almost always operated on straight 220 volts and if the amperage is in excess of 15 amps, which is a customary maximum amperage rating for many switches, a 220 volt magnetic coil may be required instead of the low voltage 24 volt coil described above. Also, if there is no need for precise temperature control, thermostat 66 may be eliminated. It will be obvious to substitute transistors, SCR's or other solid state control devices for the mechanical relays and switches shown.

Although the present invention has been described in terms of a preferred embodiment, such description is merely exemplary and is not intended to limit the scope of the invention as defined by the appended claims

What is claimed is:

1. An air conditioning system for maintaining ambient room air within a desired temperature range comprising:

a heat exchanger, selectively activated energy transfer means for cooling said heat exchanger, motor operated fan means for forcing a stream of air through said heat exchanger, timer means for alternately activating said energy transfer means for a preselected first period of time and deactivating said energy transfer means for a preselected second period of time, control means for activating and deactivating said timer means and said motor operated fan means in response to ambient room air temperatures above and below, respectively, a predetermined level and for activating and deactivating said energy transfer means during said second timer period in response to the temperature of the air from said motor fan means on the downstream side of said heat exchanger being above and below, respectively, a predetermined level, the ratio of said first and second periods remaining constant regardless of the ambient temperature responded to by said control means.

2. The air conditioning system of claim 1 wherein:

said heat exchanger includes an evaporator coil and said energy transfer means includes a compressor and a condenser so that the air circulating around said evaporator coil is cooled, and said timer means comprises a motor operated percentage timer switch which opens and closes respectively for said first and second period.

3. The air conditioning system of claim 2 wherein said control means includes means for connecting said timer switch to a source of electric power when the temperature of the ambient air exceeds the first-mentioned temperature level and for disconnecting said timer switch from its source of electric power when the temperature of the ambient air falls below said first-mentioned temperature level.

4. The air conditioning system of claim 3 wherein said control means includes a temperature responsive switch connected in parallel with said timer switch.

5. The air conditioning system of claim 2 in which said control means includes a thermally responsive switch means downstream from said fan means and said heat exchanger for overriding said timer switch means by activating said compressor during said second period if the temperature sensed by said second switch means falls below the second-mentioned temperature level.

6. An air conditioning system comprising:

a refrigerant system including a compressor, a condenser coil and fan, and an evaporator coil and fan, electrical power input terminal means, electrically operted timer switch means for alternately connecting said compressor to said input terminal means for a preselected first period of time and disconnecting said compressor from said terminal means for a preselected second period of time, control means including a first temperature sensitive switch device for actuating and deactuating said timer switch means and said evaporator coil fan in response to ambient room air temperature above and below, respectively, a predetermined level and including a second temperature sensitive switch device for connecting said compressor to said input terminal means in response to the temperature of the air from the evaporator coil fan on the downstream side of said evaporator coil being above a predetermined level, the ratio of said first and second periods remaining constant regardless of the ambient temperature responded to by said control means.

7. The air conditioning system of claim 6 including auxiliary electrical power input terminals and wherein said timer switch means includes a control switch, a relay operatively connected in series with said contol switch and said auxiliary terminals, said relay having a switch operatively connected between said compressor and said input terminal means.

8. The air conditioning system of claim 7 wherein said timer switch means is operatively connected to said auxiliary terminals.

9. The air conditioning system of claim 8 wherein said first temperature sensitive switch device is connected in series with said auxiliary terminal means and said timer switch means.

10. The air conditioning system of claim 9 wherein said second temperature sensitive switch device is positioned downstream from said evaporator fan and coil and is connected in parallel with the control switch of said timer switch means and in series with said first temperature sensitive switch device.

11. The air conditioning system of claim 10 including a relay connected in series with said first temperature sensitive switch device and having a switch connected in series between said input terminal means and said evaporator fan.

12. The air conditioning system of claim 6 in which said first temperature sensitive switch device is positioned downstream of said evaporator fan and coil for overriding said timer switch means by operatively connecting said compressor to said input terminal means during said second period if the temperature sensed by said first temperature sensitive switch device exceeds the second mentioned temperature level.

13. The air conditioning system of claim 6 wherein said second temperature sensitive switch device is positioned about 6 inches from said evaporator coil.

* * * * *